US008478159B2

(12) United States Patent
Kinoshita

(10) Patent No.: US 8,478,159 B2
(45) Date of Patent: Jul. 2, 2013

(54) IMAGE FORMING APPARATUS WITH A VIBRATION PREVENTION MEMBER

(75) Inventor: Takeru Kinoshita, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 337 days.

(21) Appl. No.: 12/825,665

(22) Filed: Jun. 29, 2010

(65) Prior Publication Data

US 2010/0329735 A1 Dec. 30, 2010

(30) Foreign Application Priority Data

Jun. 30, 2009 (JP) ..... 2009-155241

(51) Int. Cl.
*G03G 15/08* (2006.01)
*G03G 21/18* (2006.01)

(52) U.S. Cl.
USPC ..... 399/103; 399/102; 399/113; 399/114

(58) Field of Classification Search
USPC ..... 399/102, 103, 111, 113, 114, 119, 399/279
See application file for complete search history.

(56) References Cited

U.S. PATENT DOCUMENTS

| | | | | |
|---|---|---|---|---|
| 6,137,975 | A | 10/2000 | Harumoto et al. | |
| 6,317,573 | B1 * | 11/2001 | Baker et al. | 399/114 |
| 6,574,445 | B2 * | 6/2003 | Higeta et al. | 399/103 |
| 6,681,089 | B2 * | 1/2004 | Dougherty | 399/111 |
| 6,993,267 | B2 * | 1/2006 | Yoshiyuki et al. | 399/114 |
| 7,809,310 | B2 * | 10/2010 | Iwamatsu | 399/279 X |
| 2004/0165908 | A1 | 8/2004 | Harumoto et al. | |
| 2008/0159781 | A1 | 7/2008 | Noguchi et al. | |
| 2008/0226319 | A1 | 9/2008 | Takahashi et al. | |

FOREIGN PATENT DOCUMENTS

| | | | |
|---|---|---|---|
| JP | 08-076670 | * | 3/1996 |
| JP | 09-127851 | | 5/1997 |
| JP | 2000-019800 | | 1/2000 |
| JP | 2000-19839 | A | 1/2000 |
| JP | 2004-191677 | A | 7/2004 |
| JP | 2006-071671 | | 3/2006 |
| JP | 2006-171407 | | 6/2006 |
| JP | 2008-165027 | | 7/2008 |
| JP | 2008-233182 | | 10/2008 |

OTHER PUBLICATIONS

Office Action (Notification of Reasons for Refusal) dated May 10, 2011, issued in the corresponding Japanese Patent Application No. 2009-155241, and an English Translation thereof.

* cited by examiner

*Primary Examiner* — Sandra Brase
(74) *Attorney, Agent, or Firm* — Buchanan Ingersoll & Rooney PC

(57) ABSTRACT

A developing unit is pivotally supported by a pivot pin so as to be swingable, and a forcing lever forces a developing roller towards a photosensitive drum so that an outer circumferential surface of a DS roller makes contact with an outer circumferential surface of the photosensitive drum. This maintains, at a specified value, a developing gap between the photosensitive drum and the developing roller. A sympathetic vibration prevention member in which an elastic member is provided on an upper surface of the base member is inserted between a lower portion of a housing of the developing unit and a guide rail provided under the lower portion. This prevents the developing unit from vibrating in sympathetic with vibration during the transportation of the image forming apparatus, which prevents the toner from spilling out.

19 Claims, 10 Drawing Sheets

IMAGE FORMING APPARATUS WITH A VIBRATION PREVENTION MEMBER

This application is based on an application No. 2009-155241 filed in Japan, the contents of which are hereby incorporated by reference.

BACKGROUND OF THE INVENTION (1) Field of the Invention

The present invention relates to an image forming apparatus, and relates in particular to an image forming apparatus including a mechanism that forces a developing unit towards a photosensitive unit so as to maintain, at a specified value, a gap between a photosensitive drum and a developing roller.

(2) Description of the Related Art

An electrophotographic image forming apparatus forms an image by supplying toner to an electrostatic latent image from a developing roller included in a developing unit to develop the electrostatic latent image into a toner image, and transferring the toner image onto a recording sheet. Here, the electrostatic latent image is formed by performing exposure-scanning on an outer circumferential surface of a photosensitive drum.

In order to form a preferable toner image on an outer circumferential surface of the photosensitive drum, it is necessary to maintain, at a specified value, a gap between an outer circumferential surface of the developing roller and an outer circumferential surface of the photosensitive drum (hereinafter, "developing gap"). The following shows how the developing roller and the photosensitive drum are conventionally arranged so that the developing gap is set to the specified value. A roller for adjusting the developing gap (DS roller) is attached to a shaft of the developing roller. Here, the DS roller has a diameter slightly larger than a diameter of the developing roller. The developing roller is forced towards the photosensitive drum so that an outer circumferential surface of the DS roller makes contact with the outer circumferential surface of the photosensitive drum. Here, "to force" means to apply pressure in a predetermined direction.

In recent years, in order to facilitate maintenance, there has been known an image forming apparatus having a structure in which the developing roller and its peripheral members and the photosensitive drum and its peripheral members are formed into a developing unit and a photosensitive unit respectively so as to be detachable from a body of the image forming apparatus.

However, when the image forming apparatus having such a structure is delivered to a customer, the following problem possibly arises. That is, the developer vibrates badly in a vertical direction in sympathy with vibration during transportation of the image forming apparatus, which causes toner stored in the developing unit to spill out of an opening for the developing roller, resulting in a mess in the image forming apparatus.

In order to solve the above-stated problem, Japanese Patent Application Publication No. 2000-19839, for example, recites the following. Firstly, a developing unit having a developing roller and its peripheral members is detached from the body of the image forming apparatus. Next, a cover is attached to an opening for the developing roller so as to be covered. Then, the developing unit is delivered packaged separately from the body of the image forming apparatus.

According to a delivering method recited in Japanese Patent Application Publication No. 2000-19839 as shown above, the developing unit is packaged separately from the body of the image forming apparatus. Therefore, in this case, a delivery cost increases due to packaging material and labor necessary for packaging, and delivery efficiency decreases due to an increase in an overall packaging size of the image forming apparatus. Furthermore, when the image forming apparatus is delivered, it takes time to set up the image forming apparatus since it is necessary to unpackage the developing unit and mount the developing unit in the body of the image forming apparatus.

SUMMARY OF THE INVENTION

The problem to be solved by the present invention is to prevent the toner stored in the developing unit from spilling out even in a case where the developing unit is delivered mounted in the body of the image forming apparatus without being separately packaged from the body of the image forming apparatus.

In order to solve the above-described problem, one aspect of the present invention is an image forming apparatus that forms an image on a recording sheet, the image forming apparatus comprising: an electrostatic latent image unit that includes an electrostatic latent image carrier on which an electrostatic latent image is formed according to image data; a developing unit that includes a developer storage container that stores therein developer, and a developing roller that supplies the developer to the electrostatic latent image carrier; a forcing unit that forces the developing unit towards the electrostatic latent image unit so that the developing roller moves close to the electrostatic latent image carrier; and a vibration absorbing member that is provided in contact with the developer storage container so as to absorb vibration of the developer storage container, the vibration being caused by external force.

Also, in order to solve the above-described problem, another aspect of the present invention is an image forming apparatus that forms an image on a recording sheet, comprising: an electrostatic latent image unit that includes an electrostatic latent image carrier on which an electrostatic latent image is formed according to image data; a developing unit that includes a developer storage container that stores therein developer, and a developing roller that supplies the developer to the electrostatic latent image carrier; a forcing unit that forces the developing unit towards the electrostatic latent image unit to bring a first contact part of the developing unit in contact with a second contact part of the electrostatic latent image unit so that a gap between the electrostatic latent image carrier and the developing roller is set to a specified value, and a vibration absorbing member that is provided between the first and second contact parts.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6 is a perspective view showing a state in which the developing unit is mounted in a body frame of the image forming apparatus that is positioned in a back side in a direction perpendicular to a surface of paper on which FIG. 2 is drawn;

DESCRIPTION OF THE PREFERRED EMBODIMENT

The following describes an image forming apparatus according to a preferred embodiment of the present invention, taking a tandem-type full-color digital printer (hereinafter, "printer") as an example.

(1) Structure of Printer

Figure 1:
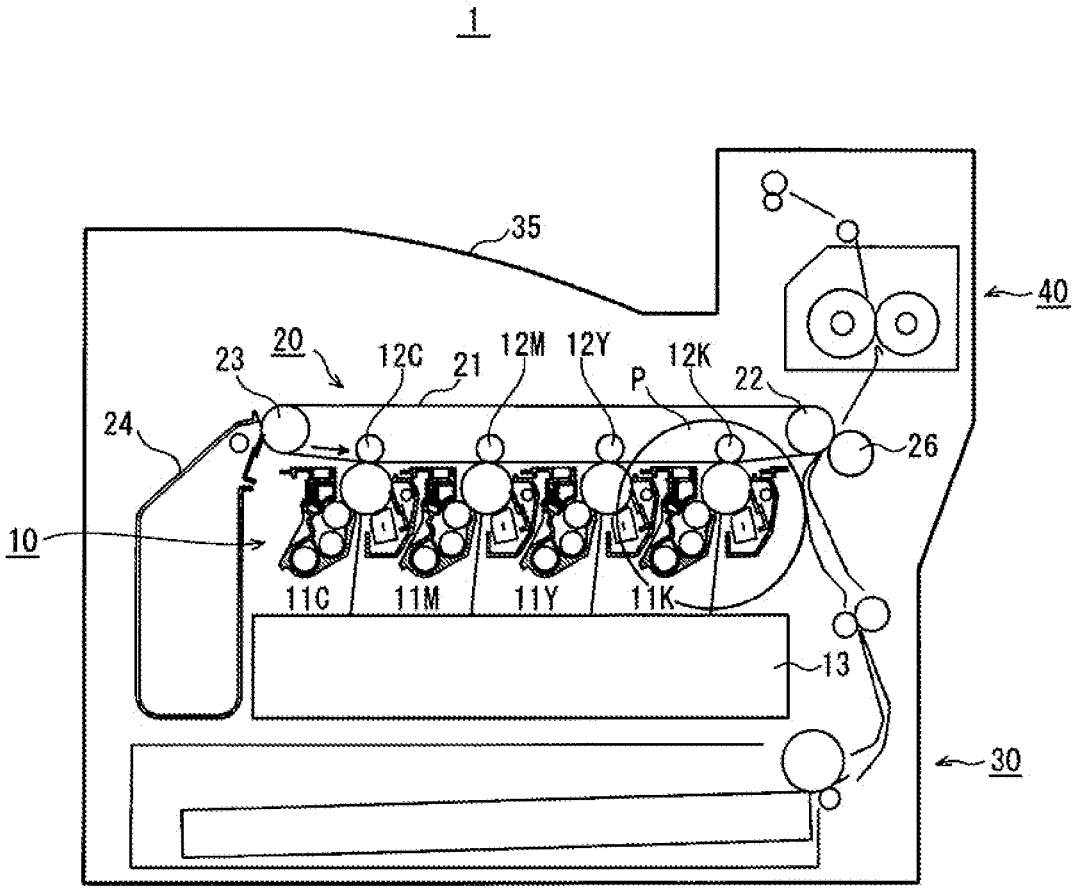
FIG. 1 is an outlined cross-sectional view showing a structure of a tandem-type full-color printer pertaining to an embodiment of the present invention.

FIG. 1 is an outlined cross-sectional view showing an overall structure of a printer 1.

The printer 1 forms an image in a well-known electrophotographic method according to image data inputted from an external terminal (not depicted). Also, the printer 1 includes an image process part 10, an intermediate transfer unit 20, a feeder 30 and a fixing unit 40.

The image process part 10 includes image formation units 11C, 11M, 11Y, and 11K for forming toner images in cyan (C), magenta (M), yellow (Y), and black (K) respectively as well as an exposure-scanning unit 13 that performs exposure-scanning of photosensitive drums 101 (see FIG. 2) of the respective image formation units 11C, 11M, 11Y and 11K.

The intermediate transfer unit 20 includes an intermediate transfer belt 21 and a cleaner 24, for example. The intermediate transfer belt 21 is supported substantially horizontally by a driving roller 22 and a driven roller 23 with tension, and rotates in a direction shown by an arrow in FIG. 1. The cleaner 24 removes toner remaining on an outer circumferential surface of the intermediate transfer belt 21, and collects the removed toner.

The photosensitive drums of the respective image formation units are exposure-scanned by the exposure-scanning unit 13, and each of the image formation units 11C, 11M, 11Y and 11K forms the toner image of the corresponding color with a predetermined timing. Then, the toner images are superimposed onto one another in the same position on the outer circumferential surface of the intermediate transfer belt 21 that is caused to rotate by an electrostatic force. Here, the electrostatic force is caused by voltage applied to primary transfer rollers 12C, 12M, 12Y and 12K that are provided in an inner side of the intermediate transfer belt 21 and are arranged in positions corresponding to the respective image formation parts 11C, 11M, 11Y and 11K. As a result, a full-color toner image is formed.

Meanwhile, the recording sheet is fed from the feeder 30 in accordance with timing that the above-stated toner image is formed. Then, the toner image primarily transferred onto the outer surface of the intermediate transfer belt 21 is secondarily transferred onto the recording sheet due to electrostatic force caused by predetermined voltage applied to a secondary transfer roller 26.

The recording sheet onto which the toner image has been transferred is thermally fixed by the fixing unit 40, and then is ejected to an external eject tray 35.

When an image is formed with use of only a black toner, only the image formation unit 11K is driven while the image formation units 11C, 11M and 11Y are relatively spaced away from the intermediate transfer belt 21 by a spacing system (not depicted) and are stopped.

Note that an openable door (not depicted) for maintenance is provided in a front side of the printer 1. The openable door opens for required maintenance such as removal of jammed paper and exchange of each unit of the image process part 10.

(2) Structures of Image Formation Units

The image formation units 11C, 11M, 11Y and 11K included in the image process part 10 basically have the same structure except for colors supplied therefrom. Therefore, the following describes, as an example, a structure of the image formation unit 11K for forming the image using the black toner.

Figure 2:
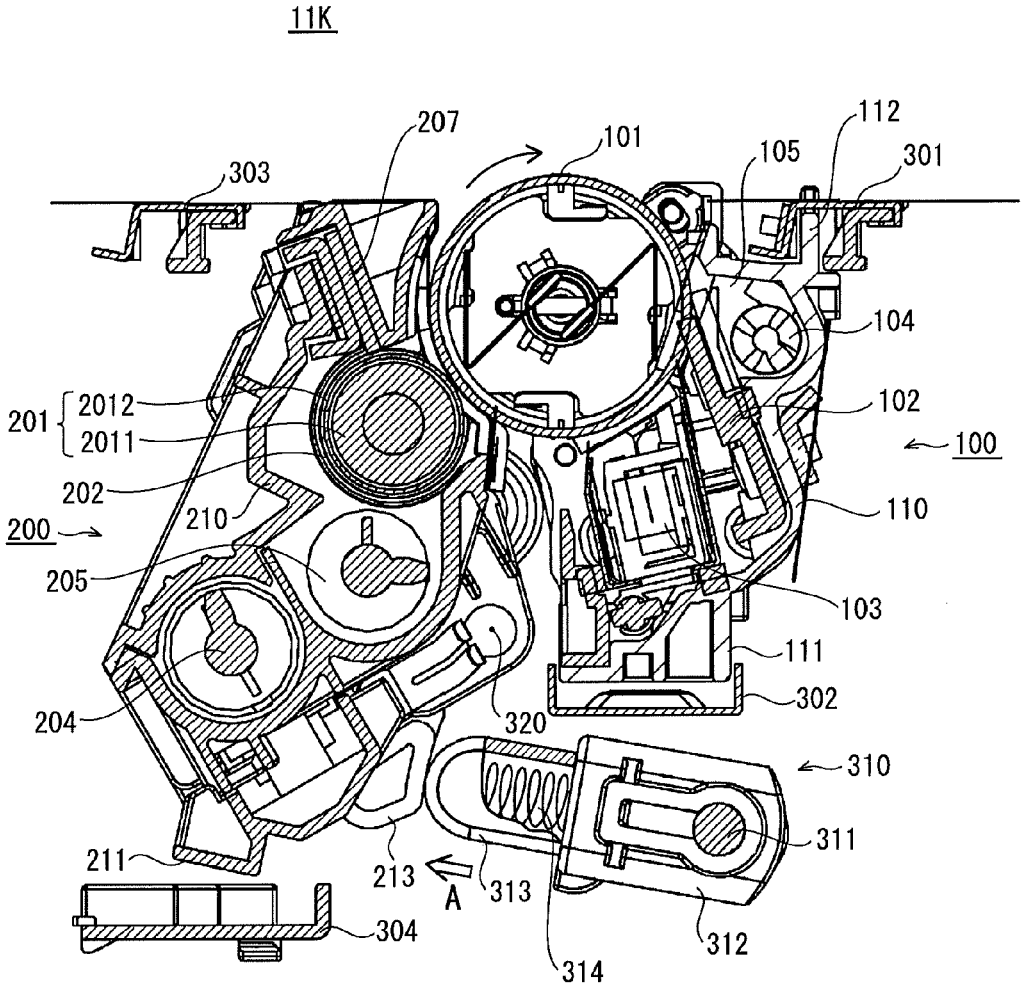
FIG. 2 is a cross-sectional view of a black image formation unit of the printer shown in FIG. 1, and shows a state in which a developing unit is forced towards a photosensitive unit so that a developing gap between a developing roller and a photosensitive drum is set to a specified value.

FIG. 2 shows a structure of the image formation unit 11K depicted in a circled portion P shown in FIG. 1. FIG. 2 shows a cross-sectional view of the image formation unit 11K that is orthogonal to a shaft of the photosensitive drum 101. However, a forcing lever 310 is partially cutaway.

In the image formation unit 11K as shown in FIG. 2, the photosensitive unit 100 including the photosensitive drum 101, and a developing unit 200 including a developing roller 201 are arranged so that the photosensitive drum 101 and the developing roller 201 face and lie adjacent to one another (in this state, the developing unit 200 is in a first position).

The photosensitive unit 100 includes a cleaning blade 102, a charger 103 and a toner collector 105, for example, in addition to the photosensitive drum 101. Here, the cleaning blade 102 removes toner remaining on the outer circumferential surface of the photosensitive drum 101, and the charger 103 charges the outer circumferential surface of the photosensitive drum 101 at a predetermined voltage.

The toner collector 105 collects the toner removed by the cleaning blade 102. Subsequently, the collected toner is conveyed by a rotational screw 104 from a forward side in a direction perpendicular to a surface of paper on which FIG. 2 is drawn (hereinafter, referred to as just "forward side") to an opposite side from the forward side in the direction perpendicular to the surface of paper on which FIG. 2 is drawn (hereinafter, referred to as "back side"), and free-falls in a collecting case (not depicted) to be collected.

The developing unit 200, on the other hand, includes a housing 210, a first stirring screw 204, a second stirring screw 205 and a doctor blade 207, for example, in addition to the developing roller 201. Here, the first stirring screw 204 conveys the toner from the forward side towards the back side while stirring it. The second stirring screw 205 conveys the toner, which has been conveyed to the back side by the first stirring screw 204, to the forward side so as to supply the toner to the outer surface of the developing roller 201. The doctor blade 207 makes an adjustment so that a thickness of a toner layer adhered to the outer surface of the developing roller 201 is a constant value. Note that the housing 210 functions as a toner storage container as well in the present embodiment.

The housing 210 of the developing unit 200 is pivotally supported by a pivot pin 320 of the body of the image forming apparatus, for example. Also, rotational momentum in a clockwise direction in FIG. 2 is applied to the housing 210 by force applied by the forcing lever 310.

According to a structure of the forcing lever 310, a hollow pressing member 313 is slidably inserted into a lever body 312 that is fixed to a shaft 311, and a compression spring 314 provided in the pressing member 313 pushes the pressing member 313 in a direction shown by an arrow A.

The developing roller 201 is configured so that a roller body 2011 is inserted into a developing sleeve 2012. A pair of rollers (hereinafter, "DS rollers") 202 each are for defining a developing gap between the developing roller 201 and the photosensitive drum 101, and are larger in diameter than the developing sleeve 2012 of the developing roller 201 by predetermined length. The DS rollers 202 are respectively provided, on the same axis as the developing roller 201, at both outer sides of the developing roller 201 in an axial direction thereof (see FIG. 5 and FIG. 6). Each of outer circumferential surfaces of the DS rollers 202 makes contact with a corresponding one of outer circumferential surfaces of end portions of the photosensitive drum 101 due to force applied by the forcing lever 310. Thus, the developing gap between the photosensitive drum 101 and the developing roller 201 is set to a specified value. Note that although this specified value is differently set depending on a model of the image forming apparatus or a type of developer, this specified value is generally set to approximately 0.2 mm to 0.5 mm.

With this structure, after the cleaning blade 102 removes the toner remaining on the outer circumferential surface of the photosensitive drum 101, the charger 103 uniformly charges the outer circumferential surface of the photosensitive drum 101 to the predetermined voltage. Subsequently, the exposure-scanning device 13 (FIG. 1) performs exposure-scanning on the outer circumferential surface of the photosensitive drum 101 by laser beam so as to form a electrostatic latent image 5 for the black toner on the outer circumferential surface of the photosensitive drum 101.

According to the developing unit 200, the toner layer that is adhered to the outer circumferential surface of the developing sleeve 2012 is regulated by the doctor blade 207 so as to have constant thickness. At the same time, the toner layer is charged by friction with the doctor blade 207. The toner layer is conveyed to a developing position that opposes the photosensitive drum 101 by rotation of the developing sleeve 2012 so as to be supplied on the outer circumferential surface of the photosensitive drum 101. Thus, the electrostatic latent image is developed into a toner image.

Note that four guide rails 301 to 304 that extend in a direction perpendicular to the surface of paper on which FIG. 2 is drawn, are attached to body frames 362 and 361, for example (see FIG. 3). When viewed cross-sectionally, upper and lower guide rails 301 and 302 that guide the photosensitive unit 100 are substantially squared U-shaped. When viewed cross-sectionally, upper and lower guide rails 303 and 304 that guide the developing unit 200 are substantially L-shaped so as to allow the developing unit 200 to rotate. Here, "to rotate" means to rotate about a predetermined pivot. Bases of the guide rails 302 and 304 that are positioned under the photosensitive unit 100 and the developing unit 200 respectively are substantially horizontal in a longitudinal direction of the guide rails 302 and 304 so that the photosensitive unit 100 and the developing unit 200 can be easily pulled out to be detached.

An upper end part 112 and a lower end part 111 of the photosensitive unit 100 slidably engage with the guide rails 301 and the guide rail 302 respectively (see FIG. 2). The photosensitive unit 100 is guided by the guide rails 301 and 302 and pulled out so as to be detached from the body of the image forming apparatus.

When the forcing lever 310 rotates in a counterclockwise direction, the force applied by the forcing lever 310 is released and the developing unit 200 is moved away from the photosensitive unit 100. Then, upper and lower portions of the housing 210 make contact with the guide rails 303 and 304 respectively, and the developing unit 200 is pulled out along the guide rails 303 and 304 so as to be detached from the body of the image forming apparatus.

Figure 3A:
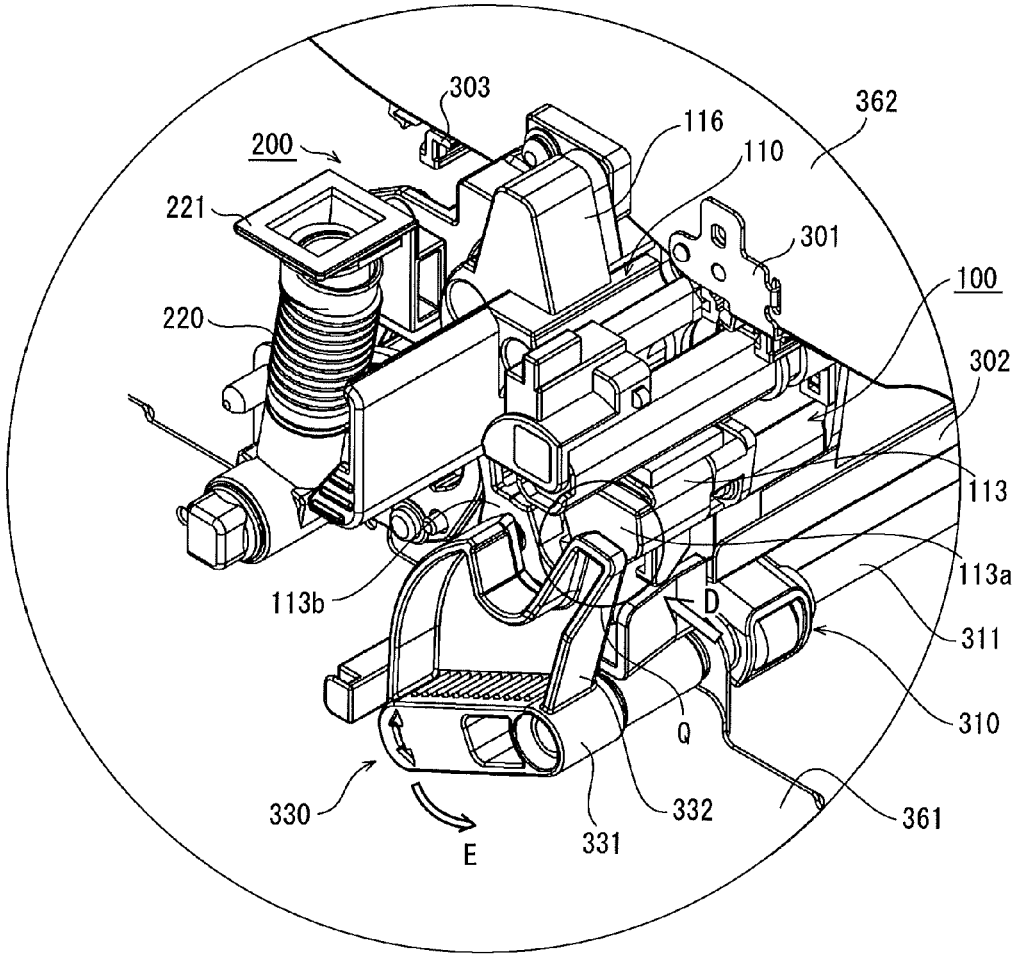
FIG. 3A is a perspective view showing a state in which the developing unit and the photosensitive unit are mounted in a body of the printer.

FIG. 3A shows a perspective view of the image formation unit 11K shown in FIG. 2.

As shown in FIG. 3A, the shaft 311 to which the forcing lever 310 is attached is borne by a body frame 361. Also, an end portion of the shaft 311 shown in FIG. 3A protrudes out from the body frame 361. A locking lever 330 is attached to a protruding portion of the shaft 311.

The locking lever 330 is composed of a lever part 331 and an engaging part 332. When the image formation unit 11K is mounted in the body of the image forming apparatus, the locking lever 330 is in a rotational position as shown in FIG. 3A. At this time, the engaging part 332 of the locking lever 330 is in contact with surfaces 113*a* and 113*b* of an end part 113 of the photosensitive unit 100 that is in the forward side so as to position the photosensitive unit 100 in the body of the image forming apparatus.

Figure 3B:
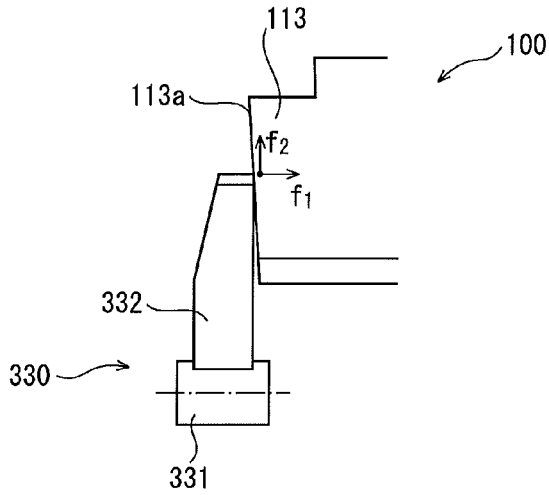
FIG. 3B shows a circled portion Q shown in FIG. 3A that is viewed in a direction shown by an arrow D.

FIG. 3B shows an engaging relation between the engaging part 332 and the surface 113*a* of the photosensitive unit 100 when a circled portion Q shown in FIG. 3A is viewed in a direction shown by an arrow D.

As shown in FIG. 3B, the surface 113*a* is taper-shaped in a manner that an upper portion thereof tilts towards the locking lever 330. Therefore, when the locking lever 330 is rotated upwards so that the engaging part 332 makes contact with the surface 113*a*, pressing force f1 and push-up force f2 are exerted. Here, the pressing force f1 is force that presses the photosensitive unit 100 in a direction parallel to an axis of the photosensitive drum 101, and the push-up force f2 is force that pushes up the photosensitive unit 100.

A housing 110 of the photosensitive unit 100 includes a protrusion 116 that protrudes upwardly at an end portion of the housing 110 that is in the forward side. Also, the housing 110 includes a positioning hole (not depicted) into which a positioning pin 365 (see FIG. 5) can be inserted when the photosensitive unit 100 is mounted in the body of the image forming apparatus. Here, the positioning pin 365 is provided so as to protrude from the body frame 362.

With the above-stated structure, the pressing force f1 and the push-up force 2 are exerted by the contact between the engaging part 332 and the surface 113*a* caused by rotating the locking lever 330, which ensures positioning of the photosensitive unit 100 in the forward side.

On the other hand, an end part 120 (see FIG. 5) of the housing 110 of the photosensitive unit 100 in the back side is provided with a cylindrical part 121 on substantially the same axis as the photosensitive drum 101. The positioning of the photosensitive unit 100 in the back side is made by fitting the cylindrical part 121 into a positioning hole 364 formed on a frame 363 (see FIG. 6) of the body of the image forming apparatus in the back side.

Returning to FIG. 3A, the developing unit 200 has a structure in which a connector 221 mounted on an opening part of a bellows-like supply path 220 is connected to an outlet of a toner container (not depicted). The toner is supplied from the toner container to the developing unit 200 via the connector 221.

Figure 4:
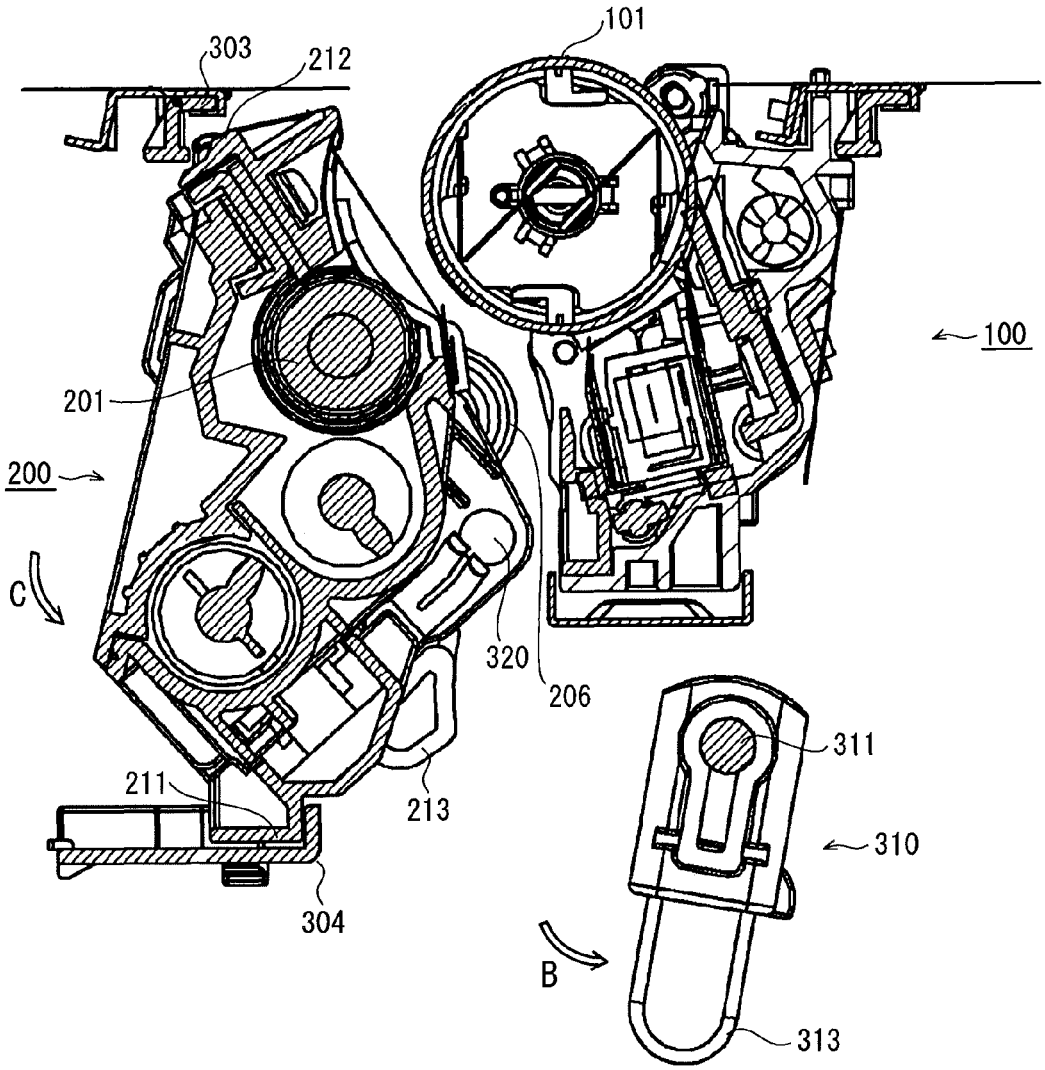
FIG. 4 shows a state in which the photosensitive unit and the developing unit are spaced away from one another by releasing the force applied to the developing unit towards the photosensitive unit.

In the above-described structure, when the locking lever 330 is swung in a direction shown by an arrow E (i.e. tilting the locking lever 330 in the direction around the pivot), locking of the photosensitive unit 100 is released. At the same time, the forcing lever 310 which is attached to the shaft 311 as with the locking lever 330 also turns in a direction shown by an arrow B as shown in FIG. 4. This releases the force applied by the forcing lever 310 to the developing unit 200. Thus, the developing unit 200 swings around the pivot pin 320 in a direction shown by an arrow C so as to move away from the photosensitive unit 100 (in this state, the developing unit 200 is in a second position). This causes a lower portion 211 and an upper portion 212 of the housing 210 of the developing unit 200 to make contact with the guide rails 304 and 303 respectively.

Figure 5:
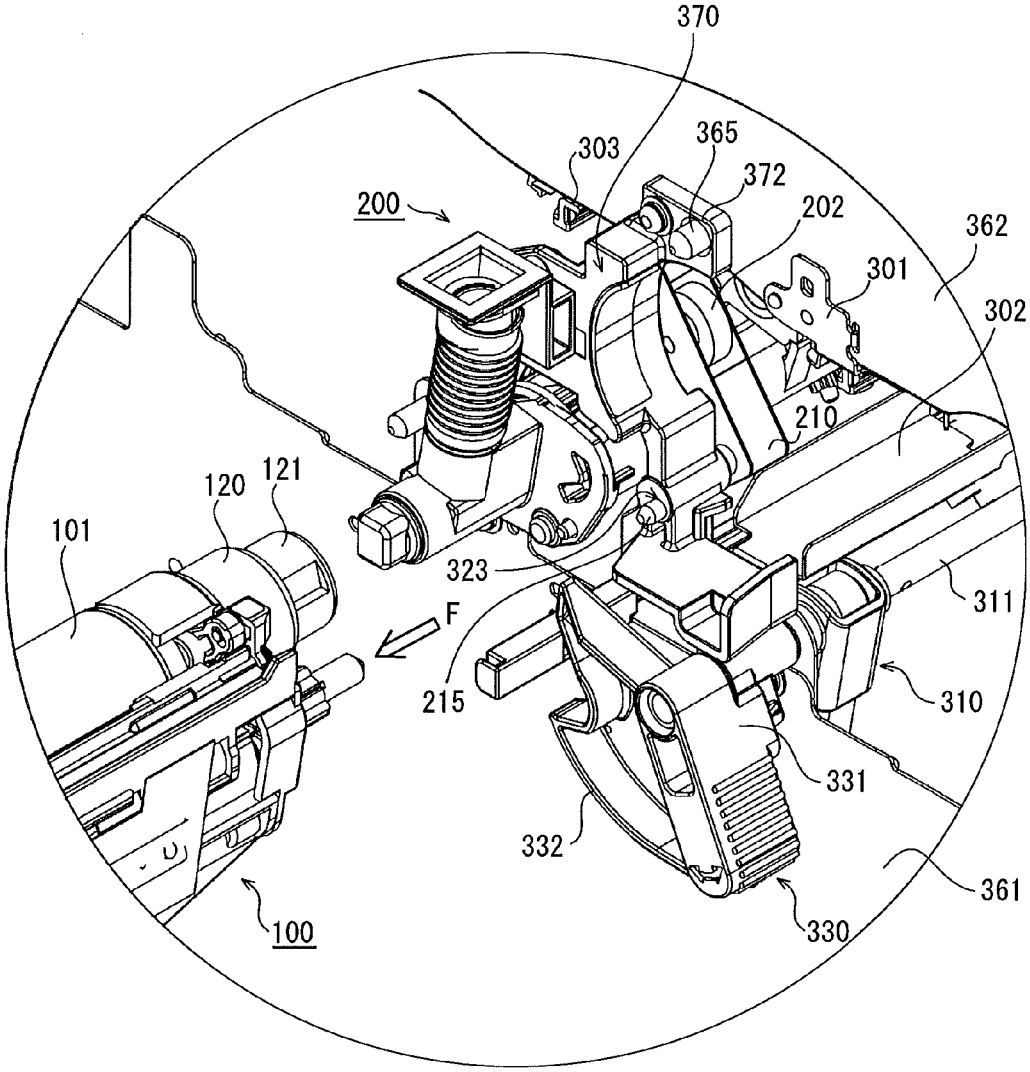
FIG. 5 is a perspective view showing a state in which the photosensitive unit is detached from the body of the printer by releasing a locking lever in FIG. 3.

FIG. 5 shows a state in which, after the locking of the photosensitive unit 100 is released, the photosensitive unit 100 is pulled forward (in a direction shown by an arrow F) from the body of the image forming apparatus along the guide rails 301 and 302.

As shown in FIG. 5, a forward-side supporting member 370 is for swingably supporting a front part of the developing unit 200. A pivot pin 215 is provided with a front portion of the housing 210 of the developing unit 200, at a position on the same axis as that of the pivot pin 320 which is provided in the back side (see FIG. 2 and FIG. 6) when the developing unit is mounted in the body of the image forming apparatus. After the pivot pin 320 is inserted into a hole 216 (FIG. 6) of the housing 210 in the back side, the pivot pin 215 in the forward side is inserted into a hole 323 provided with the forward-side supporting member 370. The forward-side supporting member 370 is mounted so as to bridge between the lower body frame 361 and the upper body frame 362. This completes the mounting of the developing unit 200.

Note that the forward-side supporting member 370, when being mounted, is positioned by fitting the positioning pin 365 provided with the upper body frame 362 into a positioning hole 372 provided on the forward-side supporting member 370. Therefore, the positioning pin 365 is used for positioning both the forward-side supporting member 370 and the housing 110 of the photosensitive unit 100 (FIG. 3).

Another positioning pin (not depicted) is provided with the lower body frame 361, and contributes to positioning of a lower end portion of the forward-side supporting member 370 as with the positioning pin 365.

Thus, many processes are necessary for mounting the developing unit 200 in the body of the image forming apparatus. Therefore, especially for the tandem-type printer including four image formation units 11C, 11M, 11Y and 11K described in the present embodiment, time taken for setting up the image forming apparatus at the time of delivery can be greatly reduced by delivering the developing unit 200 mounted in the body of the image forming apparatus.

Figure 6:
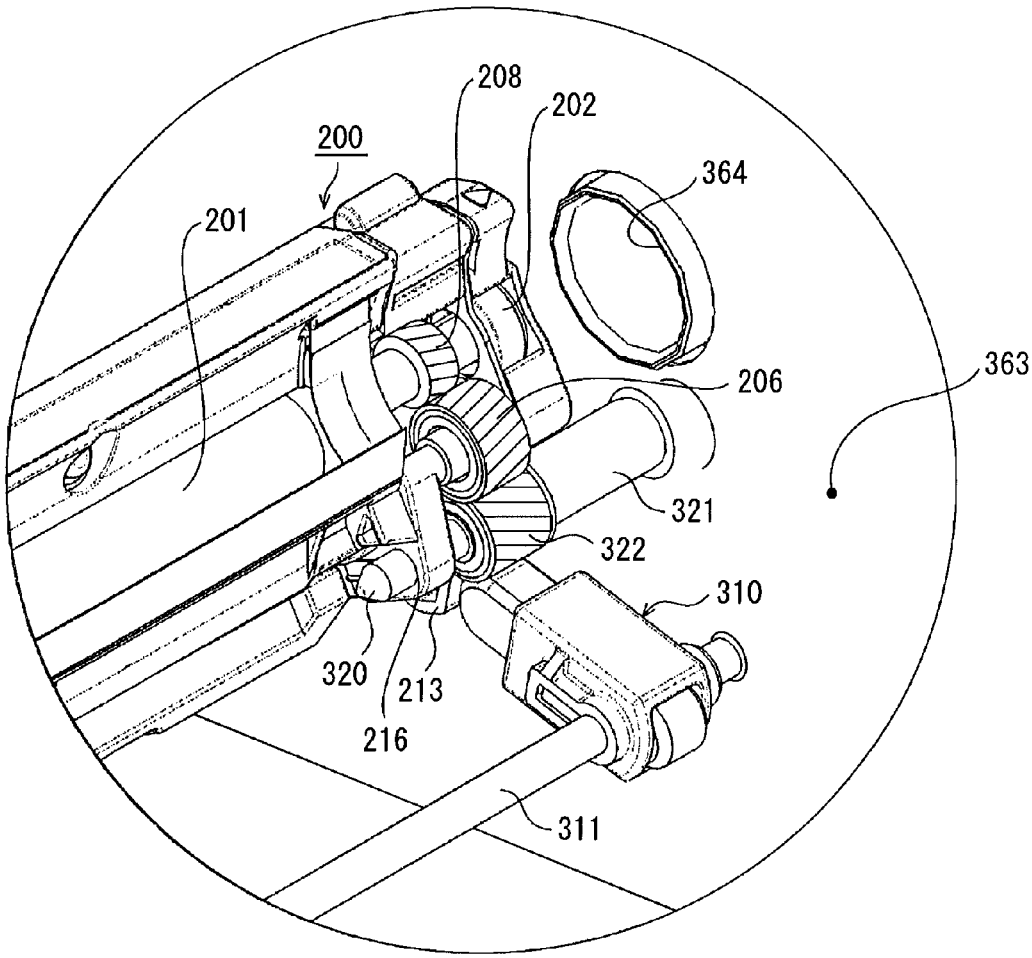

Also, FIG. 6 is a perspective view showing how the developing unit 200 is mounted in the body of the image forming apparatus in the back side.

In FIG. 6, a drive shaft 321 transmits driving force to the photosensitive unit 100 and the developing unit 200. Here, the drive shaft 321 is connected to a motor (not depicted) provided on a back side of a body frame 363.

Rotational force of the motor is transmitted to the developing roller 201 via a helical gear (hereinafter, simply referred to as "gear") 322, a gear 206 and a gear 208. Here, the gear 206 is provided in the developing unit 200 and meshes with the gear 322. The rotational force of the motor is conveyed to the first and second stirring screws 204 and 205 (FIG. 2) via another gear (not depicted).

Also, the gear 206 is configured to mesh with a gear (not depicted) provided in the photosensitive unit 100 when the developing unit 200 is set adjacent to the photosensitive unit 100 by rotating the locking lever 330 (FIG. 3). The mesh between the gear 206 and the gear provided in the photosensitive unit 100 rotates the photosensitive drum 101 of the photosensitive unit 100 (FIG. 2) and the rotational screw 104.

Note that a reduced diameter portion which is an end portion of the drive shaft 321 functions as the above-described pivot pin 320. Since the developing unit 200 is pivotally supported by the pivot pin 320, the swing of the developing unit 200 does not affect the mesh between the gear 322 and the gear 206, for example.

(3) Structure for Preventing Sympathetic Vibration in Image Formation Unit 11K Returning to FIG. 2, if the force by the compression spring 314 of the forcing lever 310 towards the developing unit 200 is excessively large, the following problems arise with the above-described structure of mounting the image formation unit 11K. That is, the pivot pin 320 possibly tilts, and unnecessarily large force applied to a contact part between the DS roller 202 and the photosensitive drum 101 prevents smooth rotational movement. Also, in the worst case, the DS rollers 202, the photosensitive drum 101 and other peripheral members are possibly damaged.

Therefore, the force to be applied by the forcing lever 310 is set so as to apply clockwise rotational momentum that is about 1.5 times larger than counterclockwise rotational momentum that is caused around the pivot pin 320 due to a weight of the developing unit 200 or reactive force applied by the photosensitive drum 101.

However, with such small force, a situation occurs in which the developing unit 200 vibrates, around the pivot pin 320, in sympathetic with vibration (especially vertical vibration) caused while the image forming apparatus is transported by a transport such as a track. This causes the developing unit 200 to vibrate badly in a vertical direction.

Thus, the toner stored in the developing unit 200 spills out of the developing unit 200 from the opening of the housing 210 for the developing roller 201, which results in dispersion of the toner inside the image forming apparatus before the image forming apparatus is delivered to customers.

Therefore, in the present embodiment, in order to prevent the sympathetic vibration of the developing unit 200 during the transportation of the image forming apparatus, a sympathetic vibration prevention member is provided between the guide rail 304 and a base of the housing 210 included in the developing unit 200. Here, the sympathetic vibration prevention member prevents the sympathetic vibration by assisting the forcing lever 310 to force the developing unit 200.

Figure 7:
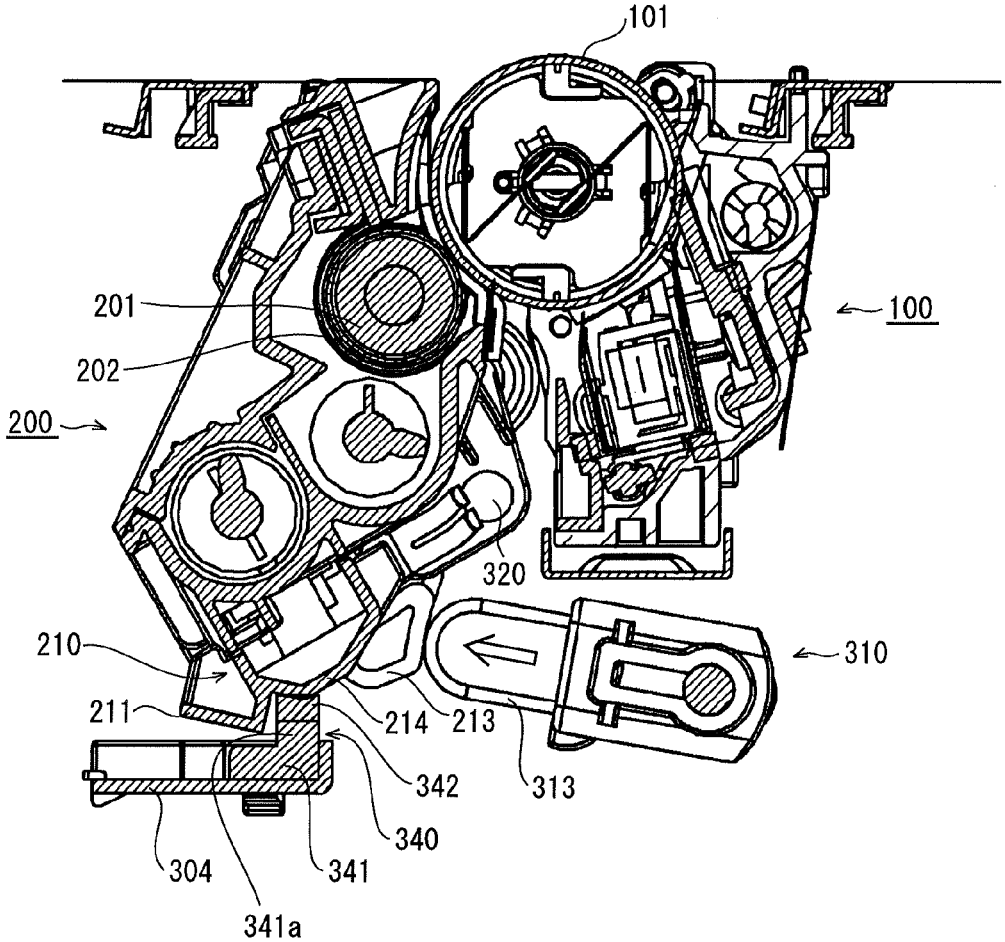
FIG. 7 shows a state in which a sympathetic vibration prevention member is inserted between a housing of the developing unit and a guide rail during transportation of the printer.

FIG. 7 shows a structure of the image formation unit 11K in the above-stated case.

As shown in FIG. 7, with a contact part 213 being forced by the forcing lever 310, a sympathetic vibration prevention member 340 is extractably inserted between the guide rail 304 and a base 214 of the housing 210 of the developing unit 200 so that the developing unit 200 is also forced upward.

Figure 8:
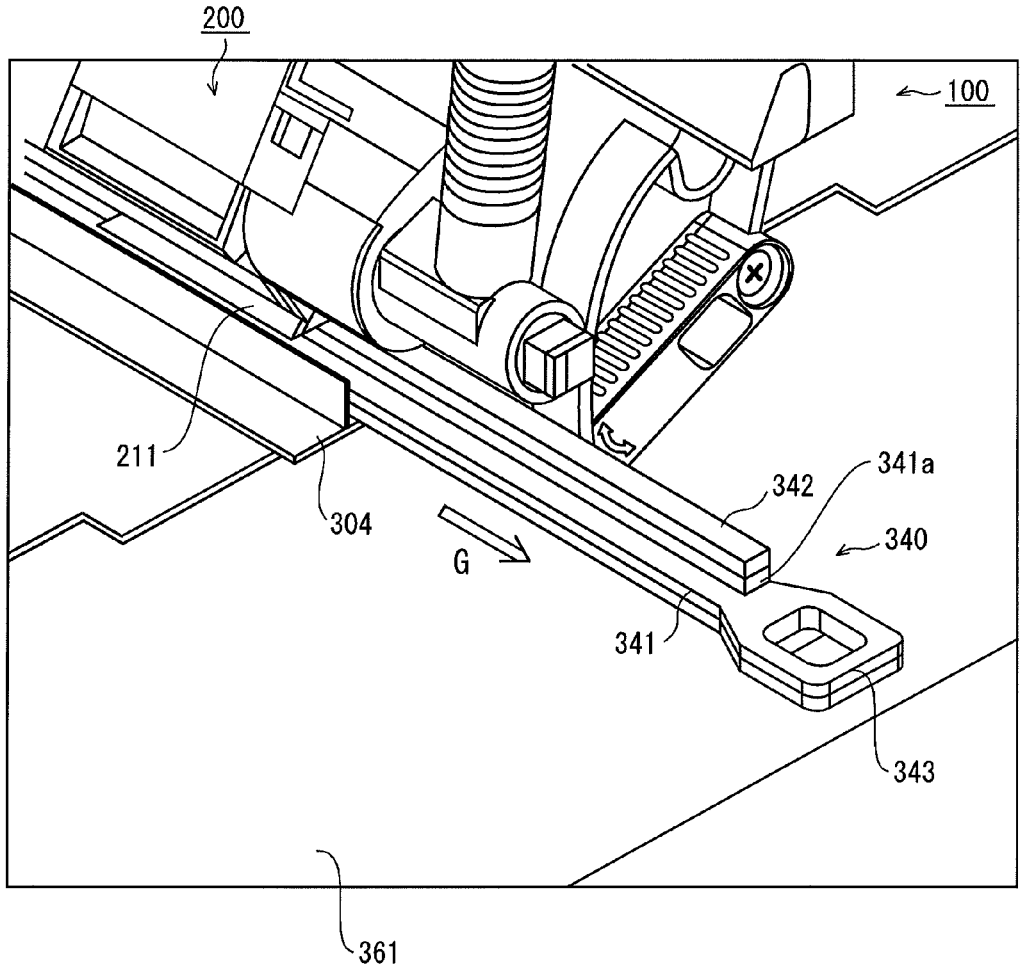
FIG. 8 shows how the sympathetic vibration prevention member is pulled out along the guide rail.

FIG. 8 shows a state in which the sympathetic vibration prevention member 340 is partly pulled forward (in a direction shown by an arrow G) along the guide rail 304. As shown in FIG. 8, the sympathetic vibration prevention member 340 has a double layer structure in which an elastic body 342 made of rubber material is adhered on an upper surface of a step portion 341*a* of a long base member 341 having a length substantially the same as a width of the developing roller 201 (FIG. 7) of the developing unit 200 in an axial direction of the developing roller 201.

Also, a grip 343 is provided at a forward-side end portion of the base member 341 (see FIG. 8) so as to be easily pulled out by an operator. Here, the grip 343 is integrated with the base member 341.

As described above, by providing the sympathetic vibration prevention member 340 between the guide rail 304 and the housing 210 of the developing unit 200, the force of repulsion by the sympathetic vibration prevention member 340 is applied to the developing unit 200 in addition to the force by the conventional forcing lever 310 which is kept within a predetermined range in view of durability when in use. Therefore, the developing unit 200 can be more forced to the photosensitive unit 100. This eliminates the possibility that the vibration of the developing unit 200 in sympathy with the vibration during the transportation of the image forming apparatus causes the toner stored in the developing unit 200 to spill out of the opening for the developing roller 201 of the developing unit 200.

Moreover, since a guide surface of the guide rail 304 is usually flat and smooth, the sympathetic vibration prevention member 340 can be easily pulled out. Thus, only small amount of time is required for setting up the image forming apparatus at the time of delivery.

Also, even if a service man, for example, forgets to remove the sympathetic vibration prevention member 340 when the image forming apparatus is delivered, operations of the image forming apparatus are not hindered for the time being since the photosensitive unit 100 and the developing unit 200 are positioned correctly and fixed by the DS rollers 202.

Thus, the developing unit 200 does not have to be packaged separately from the body of the image forming apparatus while the setting-up of the image forming apparatus at the time of delivery can be facilitated. As a result, it is possible to effectively prevent the mess in the image forming apparatus due to the spilling of the toner during the transportation of the image forming apparatus, while reducing the labor cost and the material cost.

Note that the elastic member 342 of the sympathetic vibration prevention member 340 can prevent the sympathetic vibration of the developing unit 200 more effectively with slight elasticity than it is prevented conventionally. However, it is preferable that the elastic member 342 is made of a material having enough elasticity, when combined with the force by the forcing lever 310, to cause a second rotational momentum that is about two to three times larger than a first rotational momentum. Here, the first rotational momentum occurs in the counterclockwise direction (FIG. 7) by the weight of the developing unit 200, for example, and the second rotational momentum occurs in a direction opposite from the counterclockwise direction (i.e. clockwise direction).

Also, a position between which the sympathetic vibration prevention member 340 is provided is not limited to a position between the guide rail 304 and the base of the housing 210 of the developing unit 200. Alternatively, another position may be employed as long as the force applied by the forcing lever 310 is assisted and the sympathetic vibration prevention member 340 can be easily pulled out.

The sympathetic vibration prevention member 340 as a whole may be formed of elastic material. However, with the base member 341 as described in the above embodiment, the following additional advantages can be obtained.

(a) Since the base member 341 has larger rigidity than the elastic member 342, insertion and extraction of the sympathetic vibration prevention member 340 between the developing unit 200 and the guide rail 304 can be facilitated.

(b) Since a height of the sympathetic vibration prevention member 340 is increased by a height of the base member 341, a thickness of the elastic member 342 can be reduced. Also, even if the developing unit 200 vibrates against the force by the elastic member 342, the vibration of the developing unit 200 is likely to be absorbed by the elastic member 342 so as to be reduced. Additionally, a vibration width is more reduced by at least the height of the base member 341 compared to a conventional image forming apparatus. Thus, the toner stored in the developing unit 200 is not likely to spill out.

The structure for preventing the sympathetic vibration of the image formation unit 11K is described in the above. The same structure is adopted for each of the image formation units 11C, 11M and 11Y of other colors.

By arranging the sympathetic vibration prevention member (also referred to as a vibration absorbing member) in contact with the developer storage container of the developing unit as above, the developing unit is not likely to vibrate in sympathetic with vibration during the transportation of the image forming apparatus. Therefore, the toner is not likely to spill out of the opening for the developing roller even if the developing unit is delivered mounted in the body of the image forming apparatus.

(4) Modifications

This concludes the embodiment of the present invention. It is needless to say that the present invention is not limited to the above-described embodiment, and the following modifications are possible, for example.

(4-1) In the above-described embodiment, the sympathetic vibration prevention member 340 is provided between the guide rail 304 and the housing 210 of the developing unit 200. Alternatively, the sympathetic vibration prevention member 340 may be provided between the housing 210 and a frame of another appropriate part of the body of the image forming apparatus.

However, the sympathetic vibration prevention member 340 is preferably located lower than a position of a weighted center of the developing unit 200. Furthermore, the sympathetic vibration prevention member 340 is preferably arranged in a position that makes contact with a part substantially right under (vertically under) the housing 210 of the developing unit 200 as shown in the above-described embodiment. It is a vertical direction in which the developing unit 200 vibrates the most in sympathetic with the vibration during the transportation of the image forming apparatus. The elastic member 342 more effectively absorbs the vibration of the developing unit 200 caused during the transportation of the image forming apparatus when the sympathetic vibration prevention member 340 is positioned on the base on which the weight of the developing unit 200 is put.

Although the elastic member 342 is adhered to a whole upper surface of the step portion 341*a* in a longitudinal direction of the base member 341, the elastic member 342 may be partially adhered to the upper surface of the step portion 341*a* so as to leave some space on the upper surface of the step portion 341*a*. In this case, it is preferable that the elastic member 342 is adhered in such a position that the force is applied to the developing roller 201 evenly in the axial direction thereof. However, it is easier, in the former case than in the latter case, to insert the sympathetic vibration prevention member 340 between the guide rail 304 and the base of the housing 210 and pull the sympathetic vibration prevention member 340 out therefrom since an upper surface of the sympathetic vibration prevention member 340 is flat.

Note that the elastic member 342 of the sympathetic vibration prevention member 340 is not particularly limited as long as it has adequate elasticity. Therefore, the elastic member 342 may be formed of urethane foam or, in some cases, plate spring besides the above-described rubber material.

(4-2) Also, the elastic member 342 may be located in a position in which the force is applied in such a direction as to assist the force applied by the forcing lever 310. Furthermore, in addition to the sympathetic vibration prevention member 340, another elastic member may be provided between the developing unit 200 and the photosensitive unit 100 so as to absorb the vibration of the developing unit 200 caused during the transportation of the image forming apparatus.

In this case, it is effective to locate the elastic member in the contact part between the DS roller 202 and the photosensitive drum 101. With such a structure, the elastic member to be used can be smaller in thickness when provided on the contact part. Also, it is possible to prevent damage to the DS roller 202 and the photosensitive drum 101 caused by the vibration during transportation of the image forming apparatus.

Figure 9:
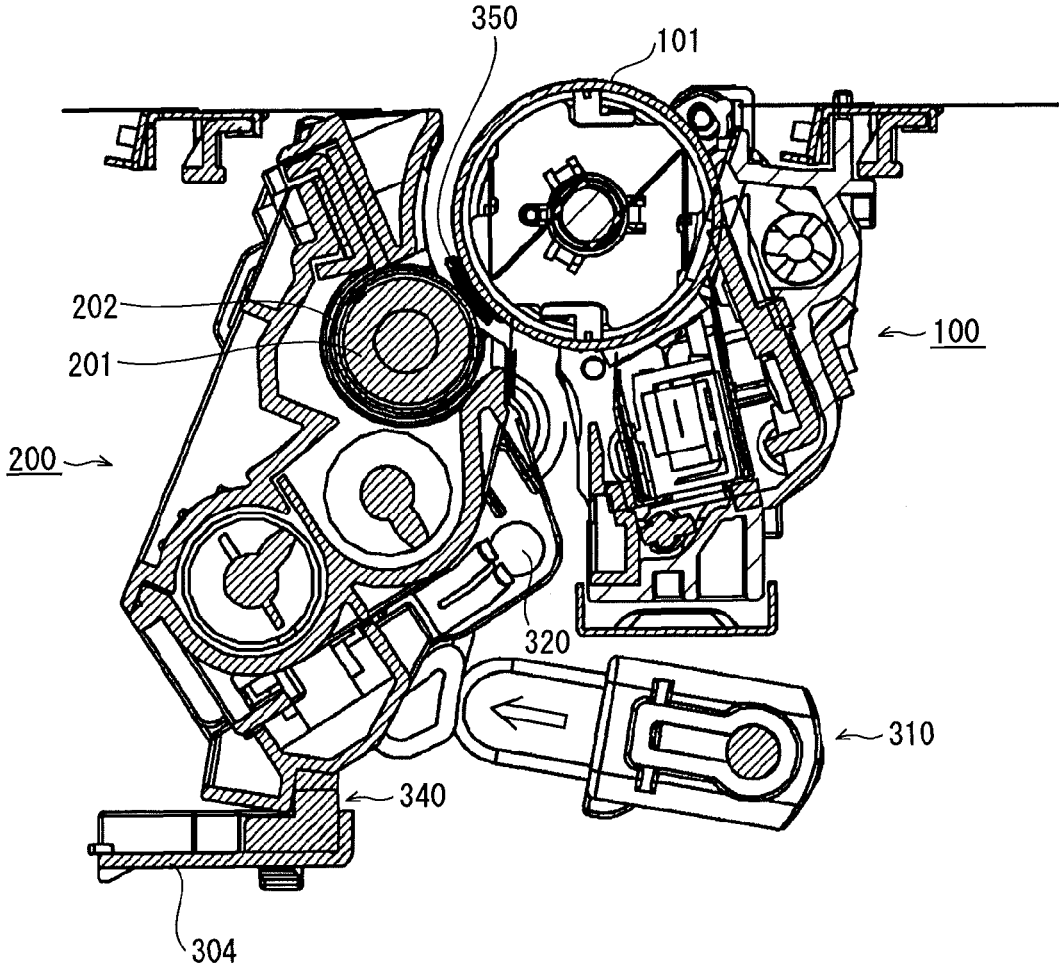
FIG. 9 shows how a sheet-shaped elastic member is adhered to a portion that makes contact with a DS roller of the photosensitive drum, as an example of a structure for preventing sympathetic vibration of the developing unit of an image forming apparatus pertaining to modifications of the present invention.

FIG. 9 shows a vibration-preventing structure pertaining to the present modifications.

As shown in FIG. 9, a vibration-preventing effect is increased by providing an elastic member 350 between the photosensitive drum 101 and the DS roller 202 in addition to the sympathetic vibration prevention member 340. The elastic member 350 is formed by applying an adhesive to one of surfaces of a sheet made of rubber or urethane foam. The elastic member 350 is adhered to a portion of the photosensitive drum 101 that makes contact with the DS roller 202. Note that even if the photosensitive drum 101 slightly rotates due to the vibration during the transportation of the image forming apparatus, a length of the elastic member 350 in a circumference direction of the photosensitive drum 101 may be increased as necessary so that the elastic member 350 is provided between the DS roller 202 and the photosensitive drum 101.

When the image forming apparatus is delivered, the locking of the photosensitive unit 100 is released by rotating the locking lever 330 (FIG. 3) to pull out and detach the developing unit 200 from the body of the image forming apparatus. Subsequently, the elastic member 350 is removed, and the developing unit 200 is re-mounted in the body of the image forming apparatus.

Note that the elastic member 350 may be adhered to the DS roller 202 instead of the photosensitive drum 101. However, according to the structure of the above-described embodiment, the forward-side supporting member 370 needs to be removed from the body frames 361 and 362 (FIG. 5) when the developing unit 200 is detached or mounted.

Such detachment and mounting is more troublesome than detaching and mounting the photosensitive unit 100. Therefore, efficiency of the setting-up of the image forming apparatus at the time of delivery is achieved by adhering the elastic member 350 to the photosensitive drum 101.

Also, in the above-described embodiment, the photosensitive drum 101 makes contact with the DS roller 202 in order to maintain, at the specified value, the developing gap between the photosensitive drum 101 and the developing roller 201. However, this is not always necessary as long as the photosensitive unit 100 and the developing unit 200 partially make contact with one another by the force applied by the forcing lever 310 so that the developing gap is the specified value. The present modification is applicable to this case.

Figure 10:
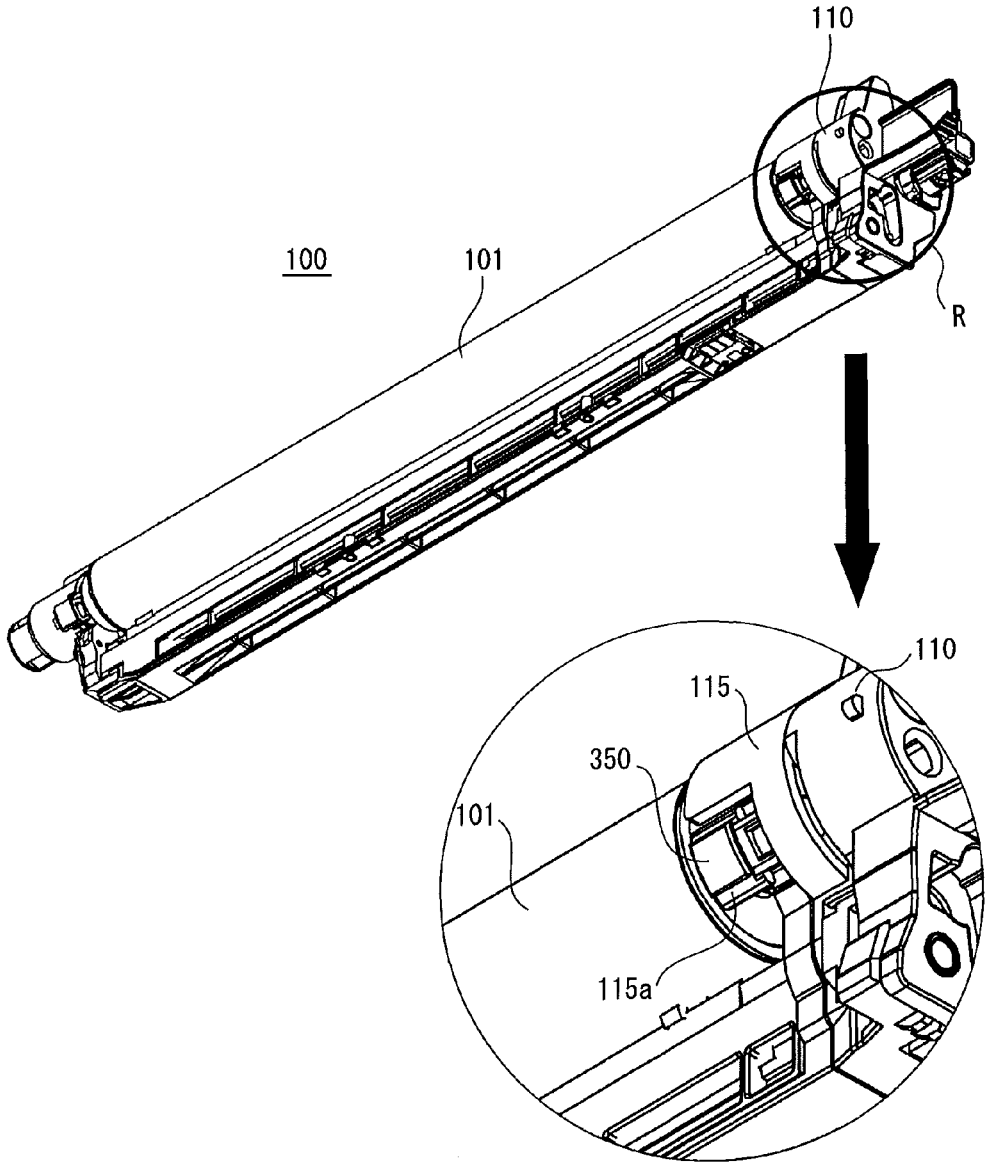
FIG. 10 is a perspective view showing how the elastic member is adhered to a contact part which is part of the photosensitive unit other than the photosensitive drum in the structure shown in FIG. 9.

FIG. 10 shows an example of the above-described case. As shown in an enlarged view of a circled portion R showing the end portion of the photosensitive unit 100, a contact member 115*a* having a cylindrical surface is provided with a bearing 115 of the photosensitive drum 101 in the housing 110 of the photosensitive unit 100. The contact member 115*a* makes contact with the DS roller 202.

It is preferable that a center of curvature of the cylindrical surface of the contact member 115*a* matches an axis of the photosensitive drum 101. However, a curvature radius of the cylindrical surface does not have to match a radius of the photosensitive drum 101. By appropriately setting a diameter of the DS roller 202 according to a size of the curvature radius of the surface of the contact member 115*a*, the curvature radius is designed so that the developing gap when the DS roller 202 and the contact member 115*a* make contact with one another is the specified value. Contact parts at other ends of the photosensitive unit 100 are similarly configured.

It is needless to say that the developing gap may be designed to be the specified value by bringing another part of the photosensitive unit 100 into contact with a part of the developing unit 200 other than the part of the DS roller 202.

Note that the elastic member 350 is provided together with the sympathetic vibration prevention member 340 in the present modification. However, even only with the elastic member 350, the force applied by the forcing lever 310 increases since the developing unit 200 is pressed back by a thickness of the elastic member 350 in addition to an effect of the vibration absorption by the elasticity of the elastic member 350. Therefore, by setting the thickness and the elasticity of the elastic member 350 appropriately, it is possible to sufficiently prevent the sympathetic vibration without the sympathetic vibration prevention member 340. Thus, it is possible to prevent the toner from spilling out during the transportation of the image forming apparatus.

(4-3) As an example of a mechanism for maintaining the developing gap at the specified value, the above-described embodiment shows the following case. That is, the developing unit 200 is pivotally supported by the pivot pin so as to be swingable to move towards the photosensitive unit 100, and the developing unit 200 is forced towards photosensitive unit 100 by the forcing lever 310. However, the mechanism for maintaining the developing gap at the specified value is not limited to this example. Therefore, the developing gap may be maintained at the specified value with the following structure, for example. That is, the developing unit 200 is held in the body of the image forming apparatus so as to slide with respect to the photosensitive unit 100. The developing unit 200 is displaced towards the photosensitive unit 100 by a mechanism similar to the above-described forcing lever 310. The photosensitive unit 100 and the developing unit 200 make contact with one another at predetermined contact positions.

The present invention is applicable to any image forming apparatus that is configured to force the developing unit towards the photosensitive unit so as to maintain a predetermined developing gap. Alternatively, both or one of the photosensitive unit and the developing unit do not necessarily have to be configured to be removable from the body of the image forming apparatus.

(4-4) Although the above embodiment describes the tandem-type full-color printer, the present invention is not limited to this. Therefore, the present invention may relate to a monochrome printer or a multifunction printer having additional functions such as a copier function and a fax function.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus that forms an image on a recording sheet, the image forming apparatus comprising:

an electrostatic latent image unit that includes an electrostatic latent image carrier on which an electrostatic latent image is formed according to image data;

a developing unit that includes a developer storage container that stores therein developer, and a developing roller that supplies the developer to the electrostatic latent image carrier;

a forcing unit that forces the developing unit towards the electrostatic latent image unit so that the developing roller moves adjacent to the electrostatic latent image carrier;

an extractably inserted vibration absorbing member that is provided in contact with the developer storage container so as to absorb vibration of the developer storage container, the vibration being caused by external force; and wherein the image forming apparatus forms the image regardless of whether the vibration absorbing member is inserted or removed.

2. The image forming apparatus of claim 1, wherein the vibration absorbing member is located in such a position as to force the developing unit towards the electrostatic latent image unit.

3. The image forming apparatus of claim 1, wherein the vibration absorbing member is located vertically under the developer storage container.

4. The image forming apparatus of claim 1, further comprising a pivot that rotatably supports the developing unit so that the developing roller moves close to and away from the electrostatic latent image carrier, wherein the forcing unit forces the developer storage container so that the developing roller moves close to the electrostatic latent image carrier.

5. The image forming apparatus of claim 1, wherein while the developing unit is forced by the forcing unit, the developing roller is positioned close to the electrostatic latent image carrier with a predetermined gap between the developing roller and the electrostatic latent image carrier.

6. The image forming apparatus of claim 1, wherein the vibration absorbing member has a double layer structure in which an elastic member is layered on a long base member.

7. The image forming apparatus of claim 6, wherein the elastic member is formed of at least one of rubber, urethane foam and a plate spring.

8. The image forming apparatus of claim 1, wherein a grip member for a pullout operation is provided at an end of the vibration absorbing member that is in a front side of the image forming apparatus.

9. The image forming apparatus of claim 1, wherein a gap between the electrostatic latent image carrier and the developing roller is set to a specified value by forcing, with use of the forcing unit, the developing unit towards the electrostatic latent image unit so that a first contact part of the developing unit makes contact with a second contact part of the electrostatic latent image unit, the image forming apparatus further comprising, an elastic member that is inserted between the first contact part and the second contact part.

10. The image forming apparatus of claim 9, wherein the elastic member is sheet-shaped and detachably adhered to a surface of one of the first and second contact parts via an adhesive.

11. An image forming apparatus that forms an image on a recording sheet, the image forming apparatus comprising:

an electrostatic latent image unit that includes an electrostatic latent image carrier on which an electrostatic latent image is formed according to image data;

a developing unit that includes a developer storage container that stores therein developer, and a developing roller that supplies the developer to the electrostatic latent image carrier;

a forcing unit that forces the developing unit towards the electrostatic latent image unit so that the developing roller moves adjacent to the electrostatic latent image carrier;

a vibration absorbing member that is provided in contact with the developer storage container so as to absorb vibration of the developer storage container, the vibration being caused by external force;

a housing in which the electrostatic latent image unit and the developing unit are arranged; and a guide rail that is positioned in the housing, and guides the developing unit so as to be pulled out from the housing, wherein the vibration absorbing member is provided between the guide rail and the developer storage container.

12. The image forming apparatus of claim 11, wherein the vibration absorbing member is extractably inserted between the guide rail and the developing unit.

13. An image forming apparatus that forms an image on a recording sheet, the image forming apparatus comprising:

an electrostatic latent image unit that includes an electrostatic latent image carrier on which an electrostatic latent image is formed according to image data;

a developing unit that includes a developer storage container that stores therein developer, and a developing roller that supplies the developer to the electrostatic latent image carrier;

a forcing unit that forces the developing unit towards the electrostatic latent image unit so that the developing roller moves adjacent to the electrostatic latent image carrier;

a vibration absorbing member that is provided in contact with the developer storage container so as to absorb vibration of the developer storage container, the vibration being caused by external force;

the vibration absorbing member is located in such a position as to force the developing unit towards the electrostatic latent image unit; and the vibration absorbing member is located vertically under the developer storage container.

14. The image forming apparatus of claim 13, further comprising:

a housing in which the electrostatic latent image unit and the developing unit are arranged; and a guide rail that is positioned in the housing, and guides the developing unit so as to be pulled out from the housing, wherein the vibration absorbing member is provided between the guide rail and the developer storage container.

15. The image forming apparatus of claim 14, further comprising a pivot that rotatably supports the developing unit so that the developing roller moves close to and away from the electrostatic latent image carrier, wherein the forcing unit forces the developer storage container so that the developing roller moves close to the electrostatic latent image carrier.

16. The image forming apparatus of claim 14, wherein the vibration absorbing member is extractably inserted between the guide rail and the developing unit.

17. An image forming apparatus that forms an image on a recording sheet, comprising:

an electrostatic latent image unit that includes an electrostatic latent image carrier on which an electrostatic latent image is formed according to image data;

a developing unit that includes a developer storage container that stores therein developer, and a developing roller that supplies the developer to the electrostatic latent image carrier;

a forcing unit that forces the developing unit towards the electrostatic latent image unit to bring a first contact part of the developing unit in contact with a second contact part of the electrostatic latent image unit so that a gap between the electrostatic latent image carrier and the developing roller is set to a specified value, an extractably inserted vibration absorbing member that is provided between the first and second contact parts;

wherein the gap between the electrostatic latent image carrier and the developing roller remains at the specified value when the vibration absorbing member is removed; and wherein the image forming apparatus forms the image regardless of whether the vibration absorbing member is inserted or removed.

18. The image forming apparatus of claim 17, wherein the vibration absorbing member is a sheet-shaped elastic member and detachably adhered to a surface of one of the first and second contact parts via an adhesive.

19. The image forming apparatus of claim 18, wherein the elastic member is formed of one of rubber and urethane foam.

* * * * *